US008668031B2

(12) United States Patent
Runia

(10) Patent No.: US 8,668,031 B2
(45) Date of Patent: Mar. 11, 2014

(54) DRILL BIT AND METHOD FOR INSERTING, EXPANDING, COLLAPSING, AND RETRIEVING DRILL BIT

(75) Inventor: Douwe Johannes Runia, Rijswijk (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 456 days.

(21) Appl. No.: 12/995,766

(22) PCT Filed: May 28, 2009

(86) PCT No.: PCT/EP2009/056568

§ 371 (c)(1),
(2), (4) Date: Jan. 21, 2011

(87) PCT Pub. No.: WO2009/147072

PCT Pub. Date: Dec. 10, 2009

(65) Prior Publication Data

US 2011/0120774 A1 May 26, 2011

(30) Foreign Application Priority Data

Jun. 2, 2008 (EP) ..... 08157395

(51) Int. Cl.
*E21B 10/66* (2006.01)

(52) U.S. Cl.
USPC ..... 175/259; 175/284; 175/291

(58) Field of Classification Search
USPC ..... 175/259–261, 284, 291
See application file for complete search history.

(56) References Cited

U.S. PATENT DOCUMENTS

| | | | | | |
|---|---|---|---|---|---|
| 1,502,463 | A | * | 7/1924 | Dunsworth | 175/261 |
| 1,597,143 | A | * | 8/1926 | Carter | 175/285 |
| 1,833,134 | A | * | 11/1931 | Stokes | 175/259 |
| 1,838,467 | A | * | 12/1931 | Stokes | 175/260 |
| 2,068,704 | A | * | 1/1937 | Powell | 175/259 |
| 2,173,018 | A | * | 9/1939 | Hurley | 175/261 |
| 2,208,457 | A | * | 7/1940 | Hurley | 175/259 |
| 2,287,714 | A | * | 6/1942 | Walker | 175/259 |
| 2,979,144 | A | * | 4/1961 | Eckel et al. | 175/232 |
| 3,306,377 | A | * | 2/1967 | Johnson | 175/261 |
| 3,409,081 | A | | 11/1968 | Brown | |

(Continued)

FOREIGN PATENT DOCUMENTS

| | | |
|---|---|---|
| EP | 1404941 B1 | 3/2005 |
| EP | 1570156 B1 | 5/2005 |

(Continued)

OTHER PUBLICATIONS

PCT/EP2009/056568 International Search Report and Written Opinion, Sep. 14, 2011 (13 p.).

*Primary Examiner* — Jennifer H Gay
(74) *Attorney, Agent, or Firm* — Chamberlain Hrdlicka

(57) ABSTRACT

A drill bit comprises a bit body connectable to a drill string at an first end, which bit body is provided with a longitudinal passageway extending from an opening at the first end to a port at a second end. The drill bit further comprises a closure element for closing the passageway, and when the closure element is in a closing position, the closure element is removable. Further, the closure element comprises a first and a second member that are movable relative to each other between an expanded configuration and a collapsed configuration, in which collapsed configuration, the closure element is retractable through the passageway to the first end.

15 Claims, 10 Drawing Sheets

(56) References Cited

U.S. PATENT DOCUMENTS

| | | | | |
|---|---|---|---|---|
| 3,437,159 | A * | 4/1969 | Bridwell et al. | 175/260 |
| 3,554,304 | A * | 1/1971 | Link et al. | 175/259 |
| 3,965,996 | A * | 6/1976 | Gross | 175/57 |
| 4,023,620 | A | 5/1977 | Gazda et al. | |
| 4,281,722 | A * | 8/1981 | Tucker et al. | 175/57 |
| 4,384,627 | A | 5/1983 | Ramirez-Jauregui | |
| 4,651,837 | A * | 3/1987 | Mayfield | 175/260 |
| 4,760,888 | A | 8/1988 | Saito | |
| 5,472,057 | A * | 12/1995 | Winfree | 175/57 |
| 5,881,827 | A * | 3/1999 | Ikeda et al. | 175/259 |
| 6,269,891 | B1 | 8/2001 | Runia | |
| 6,454,024 | B1 * | 9/2002 | Nackerud | 175/57 |
| 7,140,454 | B2 | 11/2006 | Runia et al. | |
| 7,188,672 | B2 * | 3/2007 | Berkheimer et al. | 166/254.2 |
| 7,207,398 | B2 * | 4/2007 | Runia et al. | 175/61 |
| 7,281,592 | B2 | 10/2007 | Runia et al. | |
| 7,287,609 | B2 | 10/2007 | Runia et al. | |
| 7,296,639 | B2 | 11/2007 | Millar et al. | |
| 7,520,343 | B2 * | 4/2009 | Hughes et al. | 175/257 |
| 7,841,400 | B2 * | 11/2010 | Wells et al. | 166/242.6 |
| 2004/0238218 | A1 * | 12/2004 | Runia et al. | 175/57 |
| 2006/0021801 | A1 | 2/2006 | Hughes et al. | |
| 2006/0118298 | A1 * | 6/2006 | Millar et al. | 166/242.7 |
| 2011/0120774 | A1 * | 5/2011 | Runia | 175/57 |

FOREIGN PATENT DOCUMENTS

| | | | |
|---|---|---|---|
| EP | 1588016 | B1 | 3/2007 |
| WO | 03004825 | A1 | 1/2003 |
| WO | 03010410 | A1 | 2/2003 |

* cited by examiner

PRIOR ART

PRIOR ART

DRILL BIT AND METHOD FOR INSERTING, EXPANDING, COLLAPSING, AND RETRIEVING DRILL BIT

CROSS-REFERENCE TO RELATED APPLICATIONS

This application is a 35 U.S.C. §371 national stage application of PCT/EP2009/056568 filed May 28, 2009, which claims the benefit of European Patent Application No. 08157395.8 filed Jun. 2, 2008, both of which are incorporated herein by reference in their entireties for all purposes.

STATEMENT REGARDING FEDERALLY SPONSORED RESEARCH OR DEVELOPMENT

Not applicable.

FIELD OF THE INVENTION

The present invention relates to a drill bit comprising a bit body provided with a longitudinal passageway extending from an opening at the first end to a port at a second end and a closure element for closing the passageway which is retractable through the passageway to the first end.

BACKGROUND OF THE INVENTION

U.S. Pat. No. 6,269,891 (hereby incorporated by reference) discloses a system for drilling and logging of 10 a wellbore formed in an earth formation, wherein a logging tool can be lowered in the wellbore from inside a drill string through a drill bit at the lower end of the drill string.

The known system comprises a drill bit including a bit body provided with a passageway for the logging tool, and a closure element for the passageway in the form of an insert section at the bit face. The bit body is attachable to a tubular drill string at a drill-string side of the bit body, and the passageway extends during normal operation in a well from an opening at the drill-string side to the well exterior of the bit body. The closure element comprises a bit-connecting means in the form of a primary latching device for selectively connecting the closure element to the bit body, so as to selectively close the passageway. The latching device can be manipulated by an auxiliary tool that forms the downstream part of a logging tool string.

The drill bit of the known system can be used for drilling operations when the closure element is connected to the bit body. When it is desired to log the formation drilling operation is stopped, the drill bit is pulled up an appropriate distance to expose the desired interval and the logging tool string with the auxiliary tool at its lower end is lowered through the drill string into the passageway. The tool-connecting means is connected to the closure element, and, simultaneously, the bit-connecting means is operated so as to release the closure element from the bit body. Then, the logging tool with the closure element attached to its lower end can be lowered into the wellbore ahead of the drill bit from where logging can be performed. After logging has been completed, the logging tool string can be pulled back into the drill string, so that the closure element is re-connected to the bit body and the auxiliary tool is simultaneously disconnected from the closure element.

U.S. Pat. No. 7,296,639 (EP1588016), U.S. Pat. No. 7,140,454 (EP 1404941), U.S. Pat. No. 7,281,592 (W003/010410), and U.S. Pat. No. 7,287,609 (EP 1570156) are all hereby incorporated by reference. These references disclose other embodiments of systems and methods for performing an operation in a wellbore ahead of a drill bit, wherein a tool is passed through a passageway in the bit body, connected to the closure element, and passed further to an external position in the borehole ahead of the bit body with the closure element connected to the lower end of the tool, at which external position the tool can be used to perform the operation.

U.S. Pat. No. 4,384,627 discloses drilling bit with a retractable pair of knives, which are the only cutting elements of the drilling bit. US 2006/0021801 A1 discloses a retrievable center bit for use with a tubular including an inner bore and a drill shoe cutter mounted thereon. The center bit is locked axially and rotationally to the tubular, so that during drilling operation the drilling forces are transmitted via the locking assembly. U.S. Pat. No. 4,760,888 discloses a coring bit with retrievable cutters. In some operations it is undesirable to have the closure element attached to the lower end of the tool.

Applicant's co-pending application PCT/EP02/07533, published as W003/004825, which is hereby incorporated by reference, discloses a drill bit assembly where the closure element is secured using a passage tool, which provides a pathway for the operating tool into the wellbore that is not obstructed by the closure element. The tubular upper part of the passage tool remains at least partly in the passageway of the bit body and serves by itself as a passageway (with a reduced internal diameter) for the operating tool, from an upstream position in the drill string to a port at its lower end, through which the operating tool can pass.

In many situations, it would be desirable to be able to retrieve the closure element to surface, having full diameter opening and enabling another tool to be inserted through the passageway into the bit body. Thus there is a need to develop a robust system which allows the closure element to be retrieved and reinserted through the passageway so another tool may be inserted unobstructed. In addition, there is a need for a method which allows coring to be done with the drill bit.

SUMMARY OF THE INVENTION

The present invention includes a drill bit comprising a bit body connectable to a drill string at a first end, which bit body is provided with a longitudinal passageway extending from an opening at the first end to a port at a second end, a closure element for closing the passageway, when the closure element is in a closing position, which closure element is removable. The closure element comprises a first and a second member which are movable relative to each other between an expanded configuration and a collapsed configuration, in which collapsed configuration, the closure element is retractable through the passageway to the first end. In a preferred embodiment the bit body, and the first and second members of the closure element are each provided with cutting elements.

The present invention includes a method for inserting, expanding, collapsing, and retrieving a drill bit comprising a bit body connectable to a drill string at a first end, which bit body is provided with a longitudinal passageway extending from an opening at the first end to a port at a second end comprising providing a closure element for closing the passageway, wherein the closure element comprises (at least) a first and a second member which are movable relative to each other between an expanded configuration and a collapsed configuration, inserting the drill bit and closure element into a borehole with the first member and the second member in a collapsed configuration, expanding the first member and second member into the expanded configuration, performing a first wellbore operation, collapsing the first member and second member into the collapsed configuration, retrieving the closure element from the borehole, inserting a wellbore tool into the passageway and performing a second wellbore operation, Removing the wellbore tool, reinserting the closure element into the collapsed configuration and expanding the first member and the second member into the expanded configuration.

BRIEF DESCRIPTION OF THE DRAWINGS

The present invention is better understood by reading the following description of non-limitative embodiments with reference to the attached drawings, wherein like parts of each of the figures are identified by the same reference characters, and which are briefly described as follows.

DETAILED DESCRIPTION OF THE INVENTION

In the present specification and in the claims, the terms upstream, upper and downstream, lower are used in relation to the lowering of a tool into a borehole, so that upstream, upper is closer to the surface than downstream, lower. The terms upstream and downstream can also be referred to as uphole and downhole, respectively.

Figure 1:
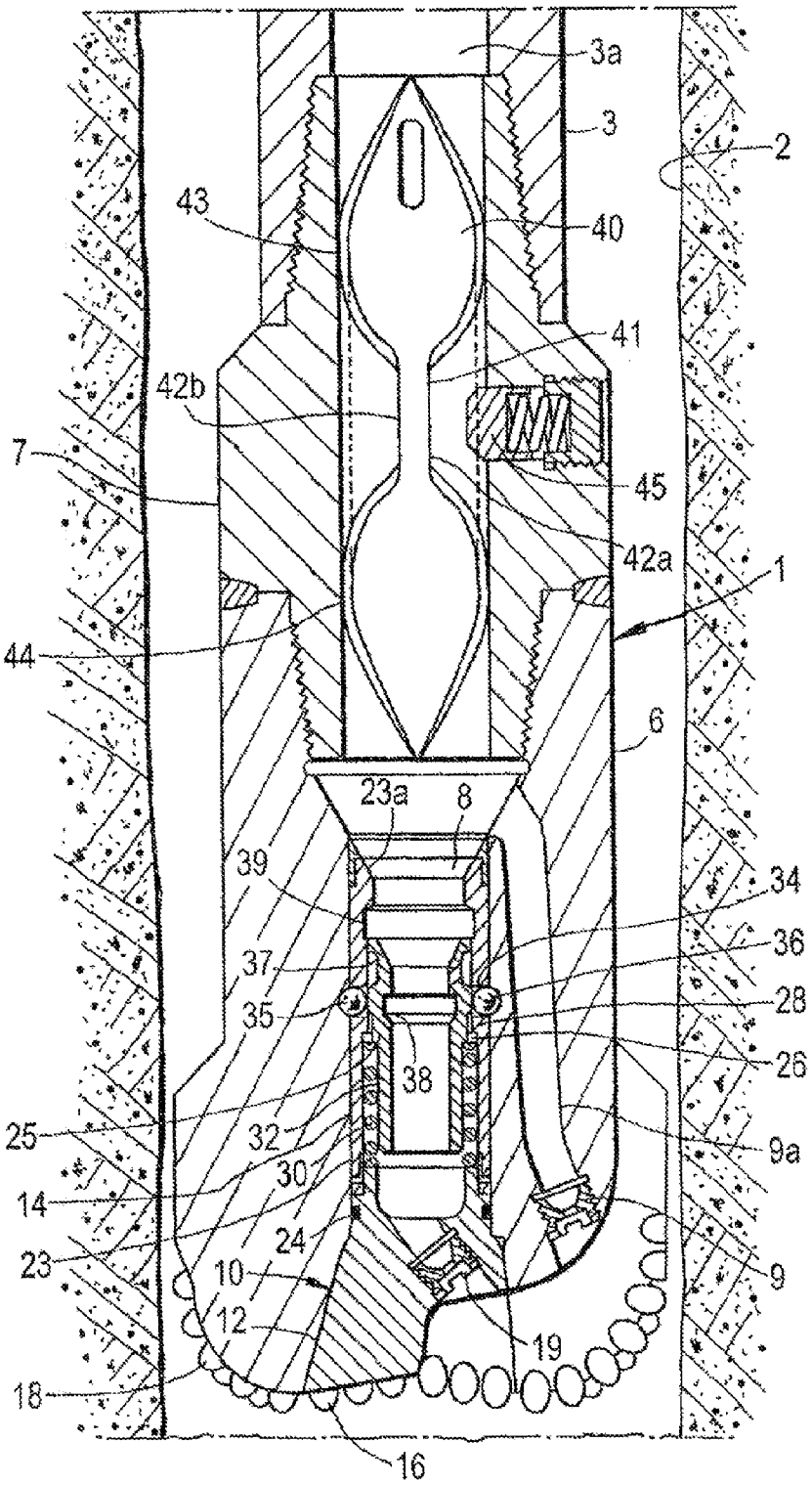
FIG. 1 shows schematically an embodiment of the known system from U.S. Pat. No. 7,296,639.

Reference is made to FIG. 1, showing a longitudinal cross-section of a drill bit 1 for through-bit operation according to U.S. Pat. No. 7,296,639. The drill bit 1 is shown in the borehole 2, and is attached to the lower end of a drill string 3. The drill bit 1 comprises a bit body 6 including a bit shank 7 which together form a central longitudinal passageway 8 for a tool, between the interior 3*a* of the drill string 3 and the borehole 2 exterior of the drill bit 1. Bit nozzles are arranged in the bit body 6. The nozzle 9 is connected to the passageway 8 via the nozzle channel 9*a*.

The drill bit 1 is further provided with a removable closure element 10, which is shown in FIG. 1 in its closing position with respect to the passageway 8. The closure element 10 of this example includes a central insert section 12 and a latching section 14. The insert section 12 is provided with cutting elements 16 at its front end, wherein the cutting elements are arranged so as to form, in the closing position, a joint bit face together with the cutters 18 at the front end of the bit body 6. The insert section is also provided with nozzles 19. Further, the insert section and the cooperating surface of the bit body 6 are shaped suitably so as to allow transmission of drilling torque from bit body 6 to the insert section 12.

It will be understood that even with the closure element in the closing position some fluid communication between interior and exterior of the bit is possible through the nozzle, but that the nozzle is not a passageway. Preferably, the smallest cross-sectional area along the passageway, when the closure element is not in the closing position, is at least 5 $cm^2$, more preferably the passageway is arranged so as to allow a cylindrical body of about 2.5 cm (1 inch) diameter to pass through the passageway. With the closure element in the closing position there is preferably no other path than through a nozzle, such as nozzle 19, for fluid to flow through the passageway.

The latching section 14, which is fixedly attached to the rear end of the insert section 12, has substantially cylindrical shape and extends into a central longitudinal bore 20 in the bit body 6 with narrow clearance. The bore 20 forms part of the passageway 8, it also provides fluid communication to nozzles in the insert section 12.

Via the latching section 14 the closure element 10 is removably attached to the bit body 6. The latching section 14 of the closure element 10 comprises a substantially cylindrical outer sleeve 23, which extends with narrow clearance along the bore 20. A sealing ring 24 is arranged in a groove around the circumference of the outer sleeve 23, to prevent fluid communication along the outer surface of the latching section 14. Connected to the lower end of the sleeve 23 is the insert section 12.

The latching section 14 further comprises an inner sleeve 25, which slidingly fits into the outer sleeve 23. The inner sleeve 25 is provided with an annular rim 26, which is biased in upstream direction against an inward shoulder 28 of the outer sleeve 23. The biasing force is exerted by a partly compressed helical spring 30, which pushes the inner sleeve 25 away from the insert section 12. At its lower end the inner sleeve 25 is provided with an annular recess 32, which is arranged to embrace the upper part of spring 30.

The outer sleeve 23 is provided with recesses 34 wherein locking balls 35 are arranged. A locking ball 35 has a larger diameter than the thickness of the wall of the sleeve 23, and each recess 34 is arranged to hold the respective ball 35 loosely so that it can move a limited distance radially in and out of the sleeve 23.

In the closing position as shown in FIG. 1 the locking balls 35 are pushed radially outwardly by the inner sleeve 25, and register with the annular recess 36 arranged in the bit body 6 around the bore 20. In this way the closure element 10 is locked to the drill bit 1, and the locking balls 35 together with the groove 36 form part of a bit-connecting means for connecting the closure element 10 to the bit body 6.

The inner sleeve 25 is further provided with an annular recess 37, which is, in the closing position, longitudinally displaced with respect to the recess 36 in the direction of the drill string 3, i.e. in upstream direction. There can also be provided inner recesses 38. The bit-connecting means can be operated by inducing a longitudinal motion of the inner sleeve 25 with respect to the outer sleeve 23, because in this way the locking balls 35 can be locked into and released from the groove 36.

The upstream end 23*a* of the outer sleeve 23 is funnel-shaped so as to guide an auxiliary tool into the latching section 14, which auxiliary tools serves to connect to the closure element and to operate the bit-connecting means. Latching recesses 39 are arranged in the outer sleeve 23, and co-operate with a tool-connecting means of the auxiliary tool.

The latching section 14 further comprises a two-way orienting device 40 and a spring-biased activation button 45, which are both arranged to co-operate with an auxiliary tool which can be deployed through the interior of the drill string for manipulating the closure element 10. The orienting device 40 comprises a guiding groove 41 formed by inwardly extending rims 42*a*, 42*b*, which extend in upstream and downstream direction fully around the circumference of the passage 8, to form an upstream camming rim 43 and a downstream camming rim 44.

The orienting device 40 is drawn as shown in FIG. 1 for the sake of clarity, suitably however it is oriented such that the guiding groove 41 is arranged opposite the button 45.

Figure 2:
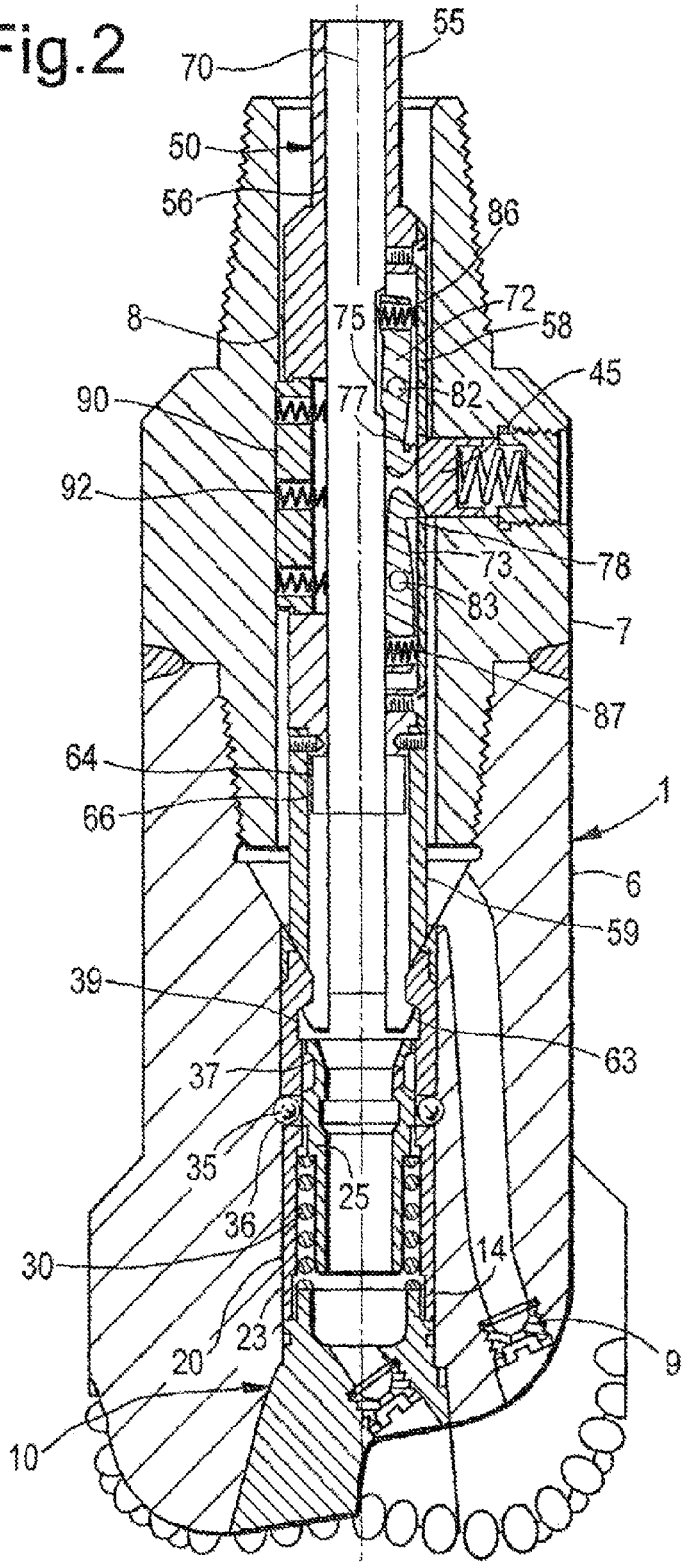
FIG. 2 shows schematically an embodiment of the known system from U.S. Pat. No. 7,296,639.

Referring to FIG. 2, the auxiliary tool 50 for manipulating the closure element 10 is arranged so that it can pass from surface through the interior of the drill string 3 (From FIG. 1), along the passageway to the closure element 10, when the closure element is connected to the bit body 6 as shown in FIG. 1. To this end the auxiliary tool is elongated and substantially cylindrical having a maximum outer diameter of less than the inner diameter of the drill string 3.

The auxiliary tool comprises a first, outer member 55 and a second member in the form of inner piston 56. The outer member 55 includes a tool-connecting means at its most downstream end. The tool-connecting means includes four latching petals 63, which are arranged to co-operate with the latching recesses 39 in the latching section 14 of the closure element 10, so as to selectively and releasably connect the auxiliary tool to the closure element.

The inner piston 56 is provided with an operating means at its downstream end, in the form of a plunger 64. The plunger 64 has a cross-shaped cross-section at its most downstream end and serves to longitudinally shift the inner sleeve 25 with respect to the outer sleeve 23 of the latching section. To this end the inner piston 56 is longitudinally movable with respect to the outer member 55. The plunger 64 is shown at 66 in a first, retracted position. With the plunger in this retracted position, the latching petals 63 of the outer member 55 have transverse flexibility towards the axis 70 of the auxiliary tool, so that they can enter into the latching section 14 and connect into the latching recesses 39. The inner piston 56 can also be longitudinally moved to assume other positions relative to the outer member 55.

The plunger 64 is arranged so that it can push onto the upper end of the inner sleeve, thereby forming an operating means for the bit-connecting means as discussed before.

The auxiliary tool is further provided with several parts that even further support fail-safe operation: Upstream trigger 72 forming a first retaining device and downstream trigger 73 forming a second retaining device are arranged on the outer member 55 to co-operate with a recess 75 on the inner piston 56 and with the button 45 of the bit body 6, as will be explained in more detail below. The triggers 72 and 73 are provided with notches 77, 78 extending through an opening 80 (not shown) in the housing 58, and are pivotably mounted about axes 82,83, wherein the ends opposite the notches are biased in the direction of the inner piston 56 by means of a spring 86,87.

The housing is further provided with a key 90 projecting out of the substantially cylindrical outer surface of the downstream part of the outer member 55, co-operating with the two-way orienting tool 40 of the bit body 6. The key 90 is elongated, parallel to the direction of the axis 70, and has tapered edges giving it a boat-like shape. The key is supported by springs 92. Instead of a boat-shaped elongated key also two separate keys that are longitudinally spaced apart can be arranged. Downstream of the key 90 and slightly angularly displaced there is an anti-collision button (not shown) in the form of a radially outwardly extending tip supported by a spring.

The inner piston 56 can further be provided with fingers (not shown for the sake of clarity) extending more downstream than the plunger 64, which fingers can co-operate with recesses 38 in the closure element 10. In this way, also the inner piston can be connected to the insert section in a predetermined position, which can further contribute to fail-safe operation in the event of strong longitudinally outward forces on the insert section 12 due to pulling or pumping.

When it is desired to open the passageway 8 by removing the closure element 10 from its closing position, the drill bit is first positioned a distance above the bottom of the borehole. Then, the closure element 10 can be outwardly removed from the closing position in the drill bit 1.

The auxiliary tool 50 is lowered from surface or from a position inside the drill string 3 (from FIG. 1) along the passageway 8 from the drill string through the 10 opening of the drill string side of the bit body into the bit body 6. When the Auxiliary tool 50 is landed onto the latch sleeve 25 and the petals 63 have entered the recess 39, the upper trigger 72 is opposite the button 45 which frees the inner piston 56 to slide longitudinally relative to the outer member 55. The plunger 64 engages the upstream end of the inner sleeve 25, which has a smaller inner diameter than the diameter of the plunger 64. Further downstream motion of the inner piston causes the inner sleeve to be pushed against the force of the spring 30, until the locking balls 35 register with the recesses 37. The locking balls are therefore allowed to move inwardly, thereby unlocking the closure element from annular recess 36, i.e. from the bit body. In this way the plunger 64 forms an operating means for the bit-connecting means.

By further pushing on the auxiliary tool 50 in downstream direction the plunger 64 is first locked down, (by the lower trigger 73 locking into the recess 75) and then the closure element 10 is outwardly removed from the bit body 6. The auxiliary tool can for example be mounted on the lower end of a logging tool, so that the logging tool can in this way be passed into the open borehole ahead of the bit body 6, where logging measurements can be performed. If instead of a logging tool a fluid injection tool is used, fluid injection operations can be performed in the borehole, e.g. cementing, injection of lost circulation material, or jet cleaning of the borehole wall or of the bit cutters.

The embodiment shown in FIG. 1 enables the closure element to be removed and connected from the bit body. The closure element cannot, however, be retrieved from the longitudinal passageway in an upstream direction to allow insertion of other tools. Although another tool could be inserted by pushing the closure element to the bottom of the borehole, this would result in the permanent loss of the closure element.

Figure 3:
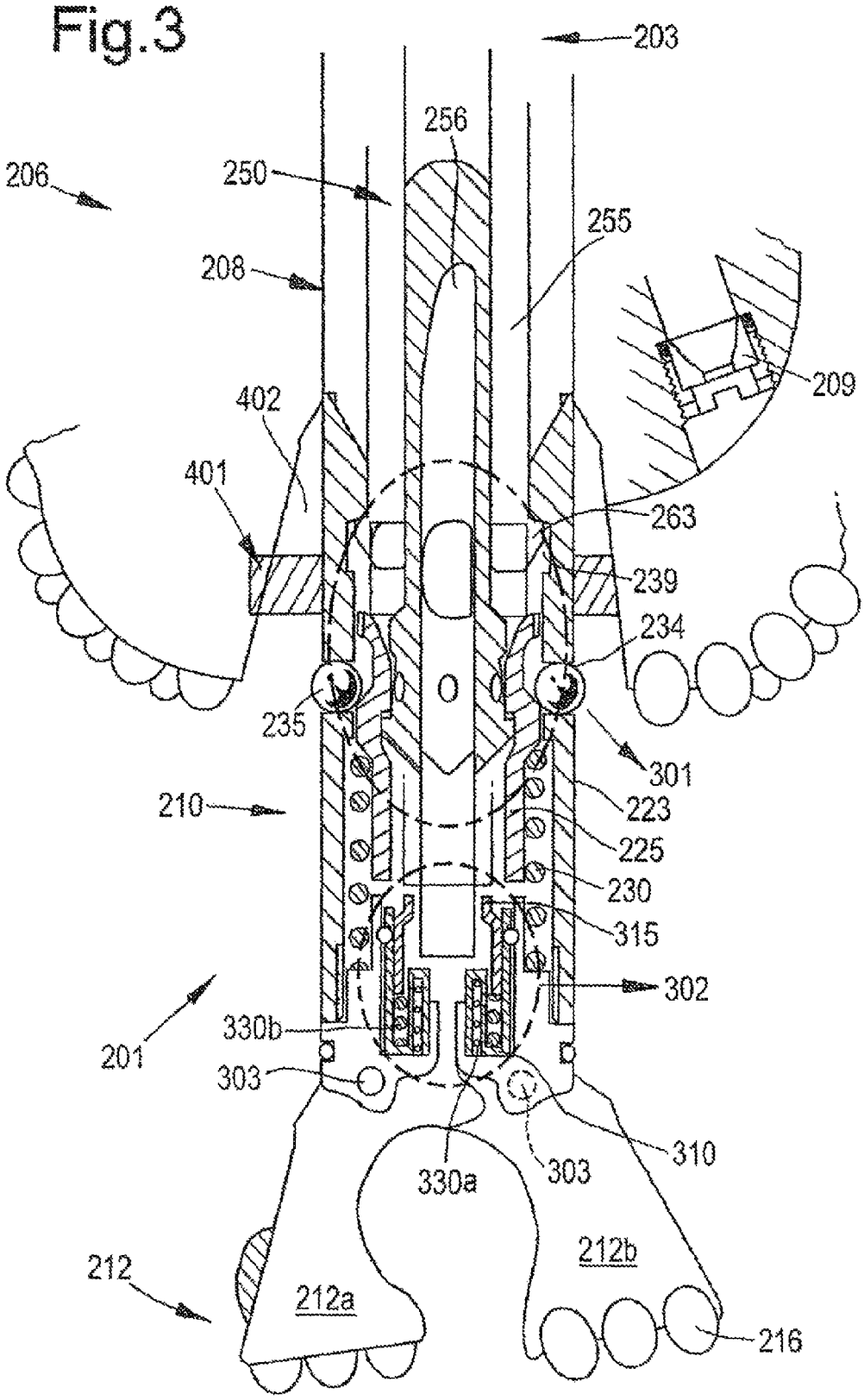
FIG. 3 shows schematically a drill bit comprising a bit body and a closure element according to an embodiment of the invention.

The present invention provides a way to retrieve the closure element in an upstream direction for insertion of another tool. Referring to FIG. 3, an embodiment of the present invention is shown in a fully expanded configuration. The invention is similar to the drill bit described in U.S. Pat. No. 7,296,639. The present invention includes additional features, which enable the closure element to be expanded or collapsed so that it can be removed in an upstream direction from the longitudinal passageway and optionally reinserted.

In FIG. 3, drill bit 201 is shown attached to the lower end of drill string 203. In operation drill string 203 and drill bit 201 are inserted in a borehole (not shown). The drill bit 201 comprises a bit body 206 and a central longitudinal passageway 208 extending from an opening at the upstream end (first end) to a port at a downstream end (second end). Bit nozzles 209 are arranged in the bit body 206. Although only one nozzle is shown in this example, several nozzles may be used in other embodiments of the invention.

The bit body 206 comprises a removable closure element 210, which is moveable between a connected position and a disconnected position. In this embodiment closure element 210 comprises insert 212, primary latch system 301, and secondary latch system 302. The insert 212 comprises a first member 212*a* and a second member 212*b*, which are connected via hinge pin 303. The first member 212*a* and second member 212*b* are movable relative to each other between an expanded configuration and a collapsed configuration. In the collapsed configuration, the closure element 210 is retractable through the longitudinal passageway 208 to the upstream end (first end).

When the closure element 210 is in the connected position, it forms a joint bit face with bit body 206. In this configuration, the first and second members are supported by the way the mechanisms fit together and the load is not supported by the primary latch mechanism.

In a preferred embodiment of the drill bit of the invention the insert section of the closure element and a cooperating surface of the bit body are shaped so as to allow transmission of drilling torque from the bit body to the insert section, so that the bit-connecting means does not support a load whilst drilling. In the embodiment shown, the first member 212*a* and second member 212*b* comprise hingeable drill blades which comprises cutting elements 216. The cutting elements 216 may be polycrystalline diamond cutters or any other material known or used in the art.

The drill bit 201 is provided with a bit-connecting means for removably connecting the closure element 210 to the bit body 206. In one embodiment, the bit-connecting means is the primary latch system 301. In one embodiment primary latch system 301 is identical to latching section 14 in FIGS. 1 and 2. However other systems known or used in the art may be used for the bit-connecting means.

In the embodiment shown, the bit-connecting means comprises primary latch system 301 which is fixedly attached to the rear end of the insert section 212 and extends into a central longitudinal bore in the bit body 206 with narrow clearance. The bore forms part of the passageway 208.

Via primary latch system 301 the closure element 210 is removably attached to the bit body 206. The primary latch system 301 comprises a substantially cylindrical outer sleeve 223, which extends with narrow clearance along the bore. The primary latch system 301 further comprises an inner sleeve 225, which slidingly fits into the outer sleeve 223. The inner sleeve 225 is provided with an annular rim (not shown), which is biased in upstream direction against an inward shoulder of the outer sleeve 223. The biasing force is exerted by a partly compressed helical spring 230, which pushes the inner sleeve 225 away from the insert section 212. At its lower end the inner sleeve 225 is provided with an annular recess (not shown) which is arranged to embrace the upper part of spring 230.

The outer sleeve 223 is provided with recesses 234 wherein locking balls 235 are arranged. A locking ball 235 has a larger diameter than the thickness of the wall of the sleeve 223, and each recess 234 is arranged to hold the respective ball 235 loosely so that it can move a limited distance radially in and out of the sleeve 223.

The drill bit 201 is further provided with an expansion/collapsing means for selectively bringing the first and second members into an expanded or collapsed configuration. In the collapsed configuration, the closure element 210 is retractable through the passageway 208 to the upstream end (first end).

In the embodiment shown, the expansion/collapsing means comprises secondary latch system 302. However other systems known or used in the art may be used for the expansion/collapsing means.

In the embodiment shown, the secondary latch system 302 comprises a lock cup 310, and primary sleeve 315. The lock cup 310 may be a generally cylindrical in shape with O-ring seals on the inside and outside. The lock cup 310 comprises first springs 330*a* and second springs 330*b*. Primary sleeve 315 is slidably inserted in lock cup 310 and held in place by springs 330*b*.

The bit-connecting means or the expansion/collapsing means are both operated by auxiliary tool 250. Auxiliary tool 250 is similar to auxiliary tool 50 from FIGS. 1 and 2. In addition, auxiliary tool 250 may be fitted with attachments for performing various functions including releasing and relatching insert 212. The release attachment 360 (see FIG. 4) is sized to engage secondary latch system and primary sleeve 315 to collapse and release the insert. The relatch attachment 350 (see FIG. 6) is sized to engage the inside of the secondary latch system 302 to expand a re-engage the insert 212. The auxiliary tool 250 may be run either in a configuration to unlock and retrieve insert 212 or a configuration to position the insert by expanding it.

The auxiliary tool 250 comprises a first, outer member 255 and a second member in the form of inner piston 256. The outer member 255 includes a tool-connecting means at its most downstream end. The tool-connecting means includes four latching petals 263, which are arranged to co-operate with the latching recesses 239 of the closure element 210, so as to selectively and releasably connect the auxiliary tool 250 to the closure element 210.

Figure 4:
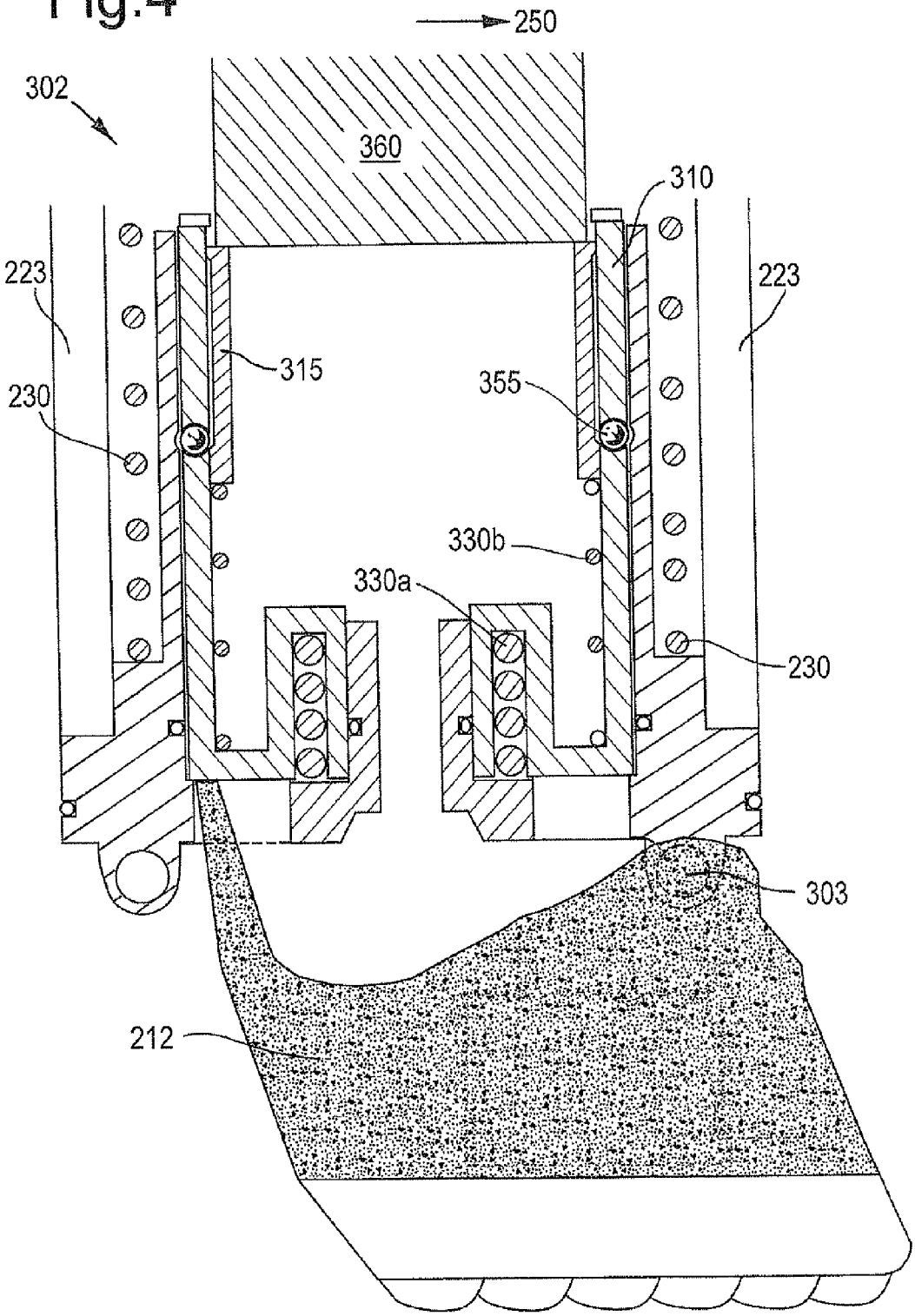
FIG. 4 shows schematically an embodiment of the closure element in a fully expanded configuration.
Figure 5:
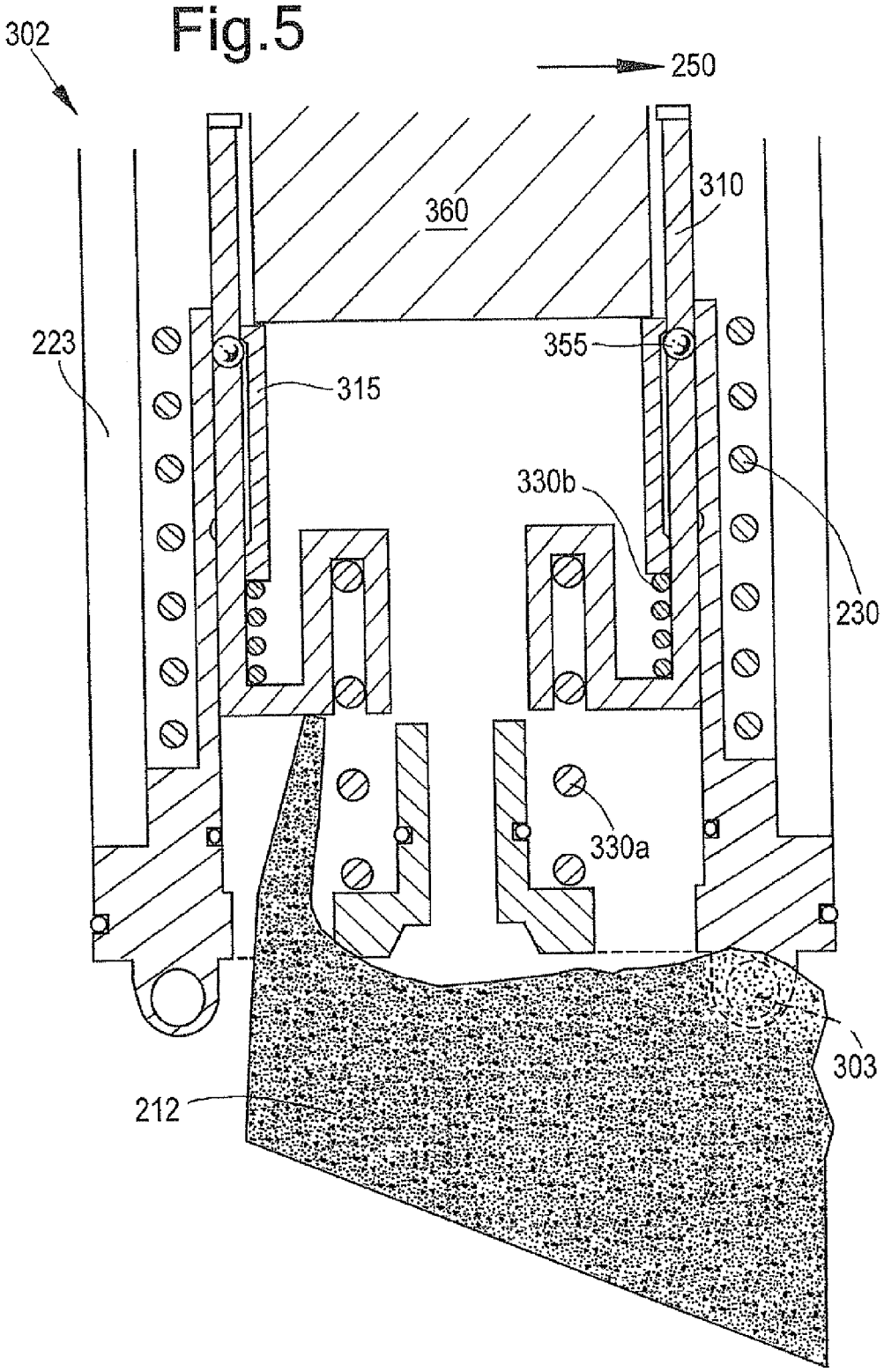
FIG. 5 shows schematically an embodiment of the closure element in a collapsed configuration.
Figure 6:
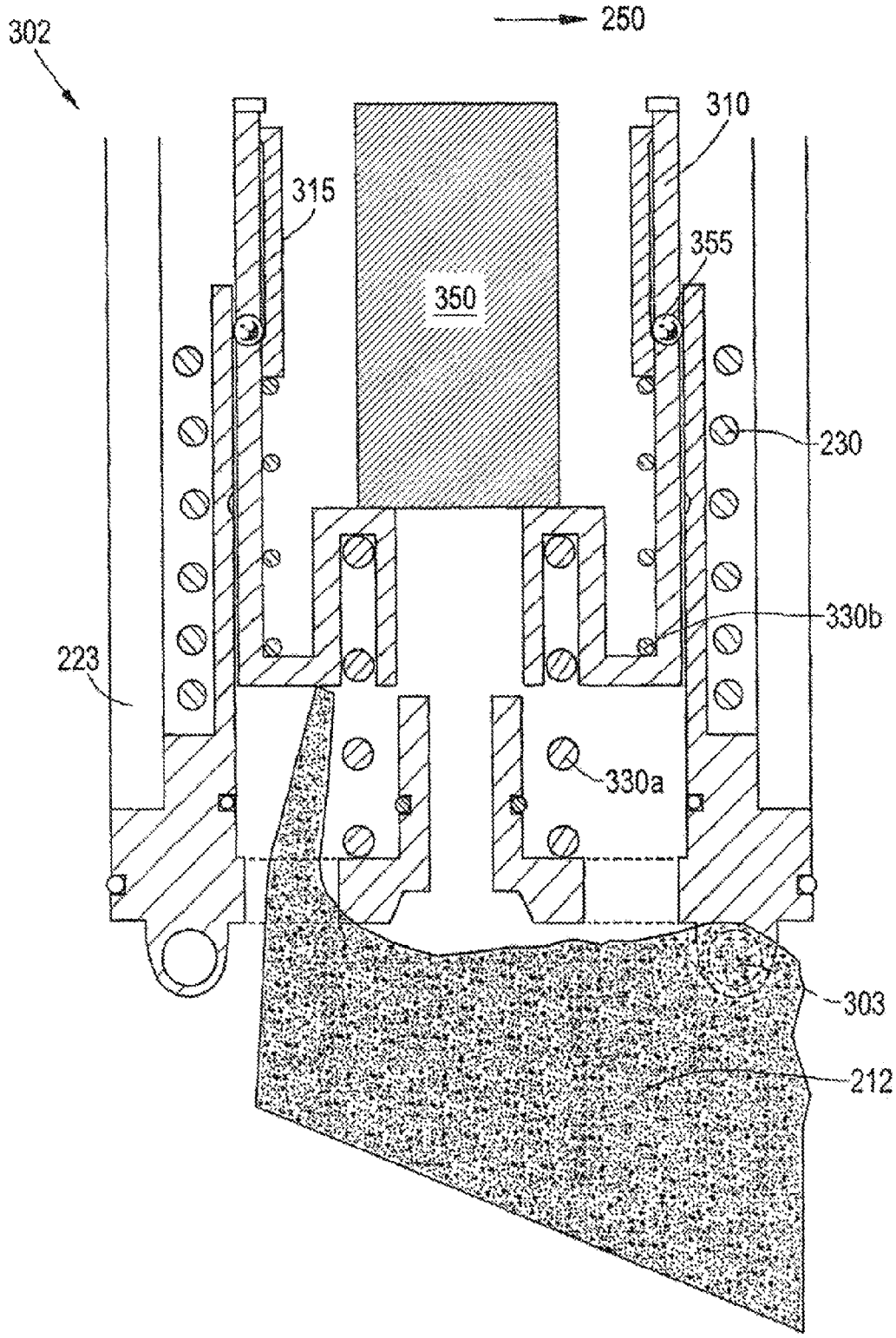
FIG. 6 shows schematically an embodiment of the closure element in a fully collapsed configuration.
Figure 7:
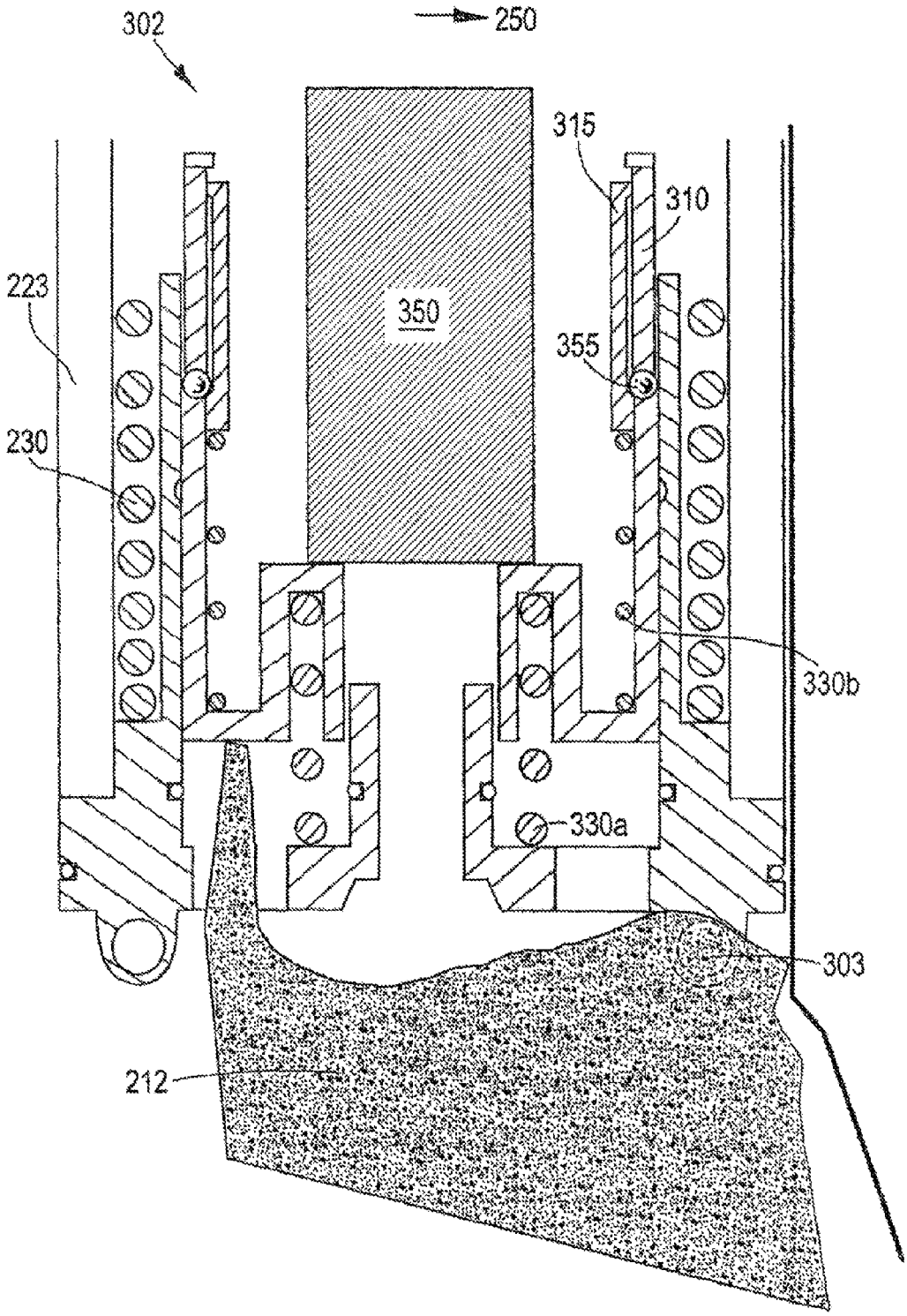
FIG. 7 shows schematically an embodiment of the closure element in a partially expanded configuration.
Figure 8:
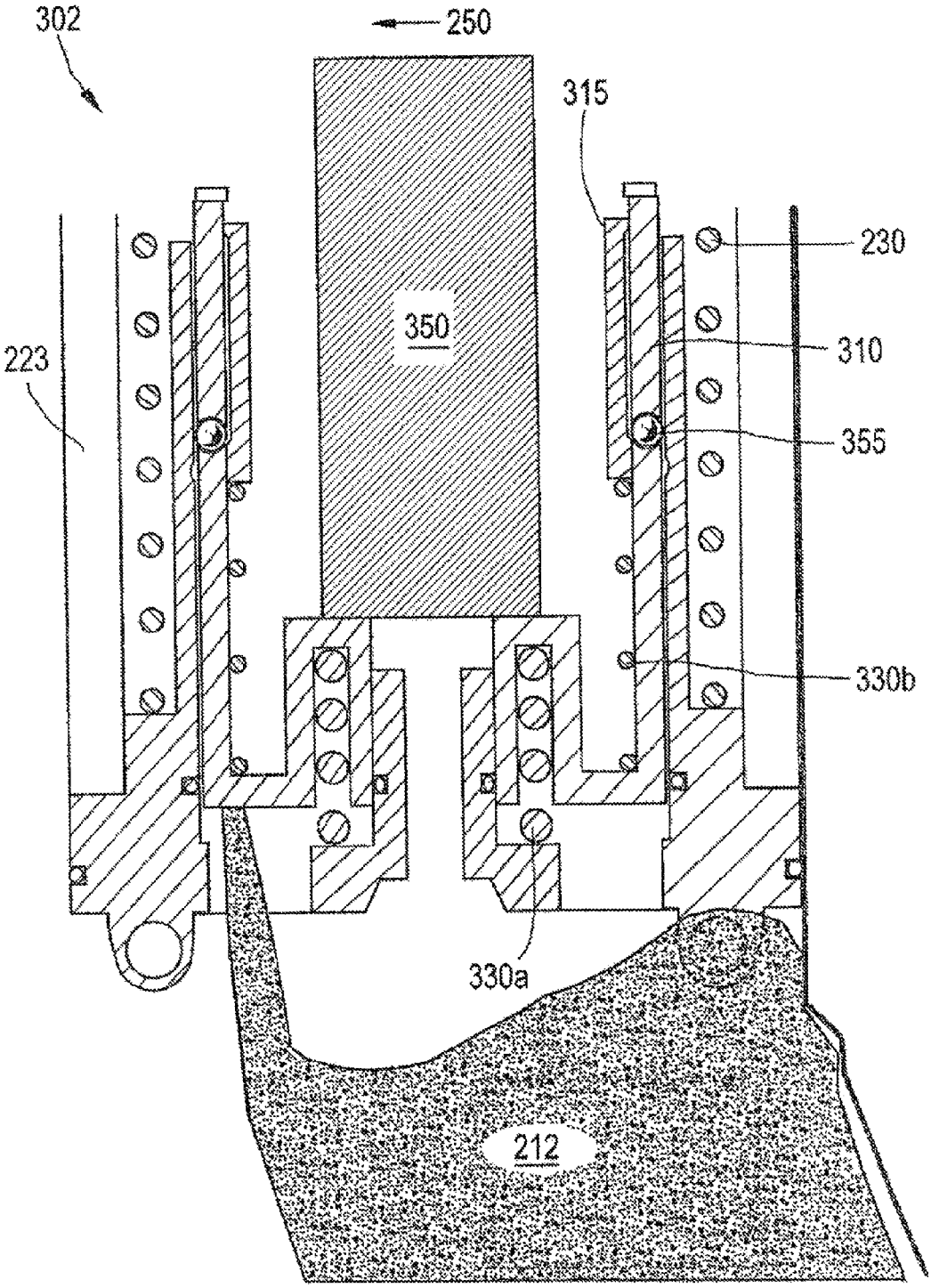
FIG. 8 shows schematically an embodiment of the closure element in yet another partially expanded configuration.
Figure 9:
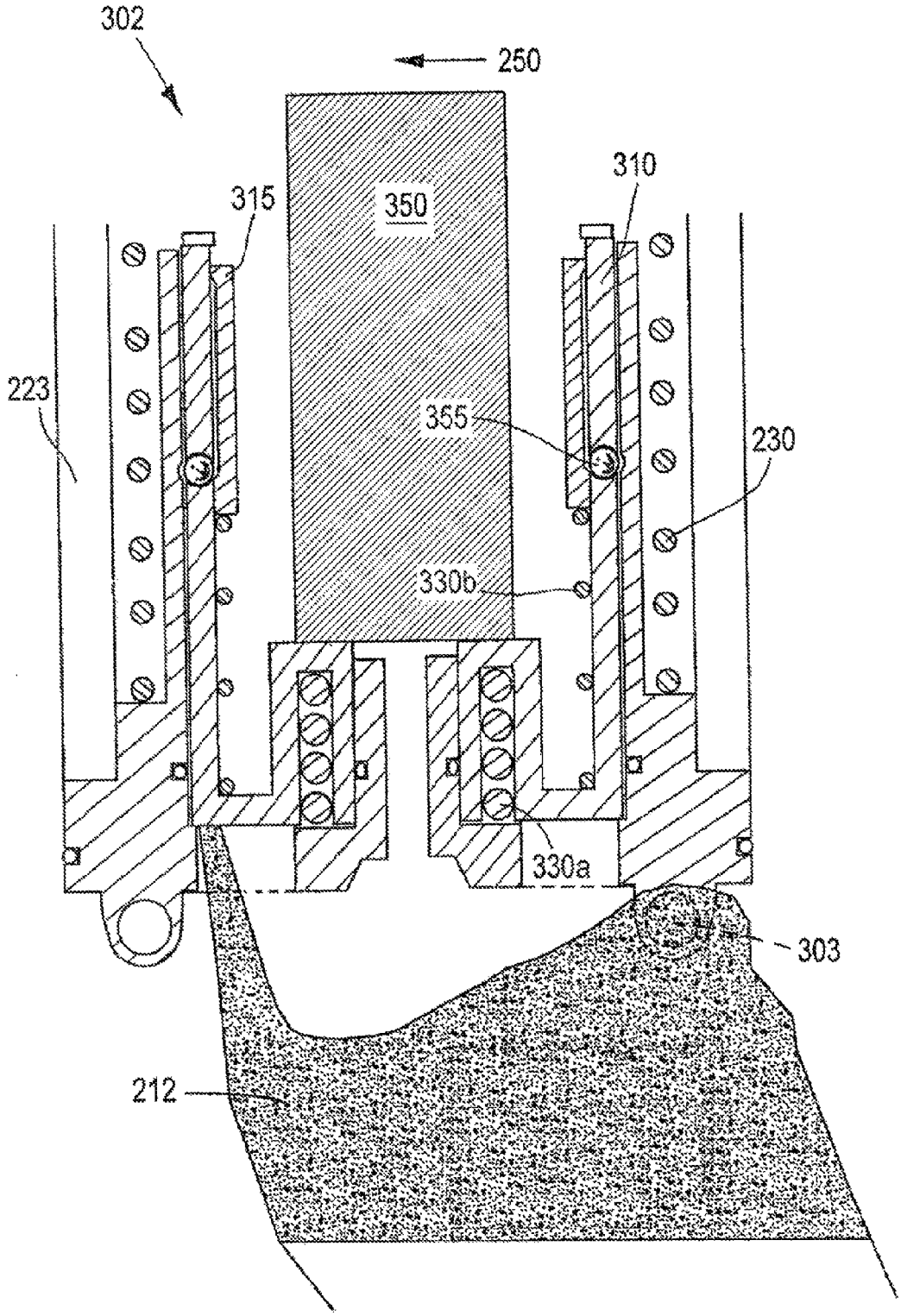
FIG. 9 shows schematically an embodiment of the closure element in a fully expanded configuration.

Reference is made to FIG. 4-9 showing several stages of the interaction between the auxiliary tool 250 and secondary latch system 302. In these Figures, an enlarged version of secondary latch system 302 in FIG. 3 is shown. FIGS. 4 and 5 depict the retrieval process for insert 212. FIG. 6 shows the insert 212 in a fully collapsed configuration as it could be run into the borehole. FIGS. 7-9 then depict the process of replacing insert 212 and expanding drill bit insert 212. Reference numerals correspond to those already used in connection with FIGS. 1 through 3.

Referring to FIG. 4, an embodiment of the secondary latch system 302 shown in FIG. 3 is depicted. For clarity only one section of closure element 210 is shown.

In FIG. 4, the insert 212 is shown in a fully expanded configuration. The insert 212 may be retrieved by running auxiliary tool 250 into the borehole (not shown). The auxiliary tool is additionally fitted with a landing member (not shown), which stops it from moving out through the bit. As the auxiliary tool 250 descends, petals 263 engage inside outer sleeve 223. When the auxiliary tools lands on the landing member, the inner piston 256 descends engaging primary latch system 301. The primary latch system 301 is fully unlatched with the trigger (not shown) engaged. In one embodiment, the trigger is modified from trigger 73 shown in FIG. 2. Once the trigger is cocked, it cannot be released down hole. The piston 256 moves further down and release attachment 360 pushes primary sleeve 315 in a downward direction.

As primary sleeve 315 is pushed down, the locking balls 355 are freed, and spring 330*a* pushes the whole lock cup assembly 310 in an upward, released position. Spring 330*a* is substantially stiffer than spring 330*b*, thus overcoming the force of spring 330*b*, which is opposing the release of the lock cup 310. The released lock cup 310 is shown in FIG. 5. The upward movement of the lock cup is allows insert 212 to hinge inward on hinge pin 303 causing first member 212*a* and second member 212*b* (not shown) to collapse to a diameter so that insert 212 is retrievable through passageway 208.

At this point, auxiliary tool 250 with attached insert 212 may be retrieved to surface. After insert 212 is removed, a conventional wireline retrievable coring barrel may optionally be run into the borehole. Optionally additional borehole operations may be performed including, but not limited to running coiled tubing, running a logging tool, performing coring operations, installing sensing equipment, and other operations known in the art.

After the additional borehole operations are performed, insert 212 can be reinserted and replaced. As shown in FIG. 6, the collapsed version of insert 212 is run into the borehole with auxiliary tool 250. In this embodiment, the insert is pre-attached to the auxiliary tool, with the lower trigger cocked to hold the inner piston down. The trigger is now fitted with a full profile, and when the auxiliary tool is landed, the button will activate the trigger, and allow the inner piston to move up ward (required to release the primary latch mechanism 301). In addition the auxiliary tool is fitted with a landing member (not shown) to prevent the tool and insert to go further downward.

When the auxiliary tool 250 has landed, there is further movement of the inner piston 256 downwards such that relatch attachment 350 hits lock cup 310, and spring 330*a* is compressed. Relatch attachment 350 of the auxiliary tool continues to move down and gradually expand insert 212 as shown in FIGS. 7 and 8. Once release attachment 350 lands, lock cup 310 automatically expands insert 212 fully as shown in FIG. 9. When fully landed, the balls 355 are opposite the ball race, and primary sleeve 315 will be moved upward under influence of spring 330*b* and lock the lock cup in place. At this point, the direction of auxiliary tool 250 may be reversed causing inner piston 256 to retract and release primary latch system 301. The auxiliary tool may then be retrieved to surface.

In some embodiments, there may be a need to use drill bit 201 as a coring bit. Referring back to FIG. 3, additional coring cutters 401 are optionally placed on the inside of the bit crown at the entrance to the passageway 208. A port 402 at the downstream end (second end) of the bit body 206 forms a central opening of the bit body, and wherein the surface of the central opening where coring cutters 401 may be placed.

Figure 10:
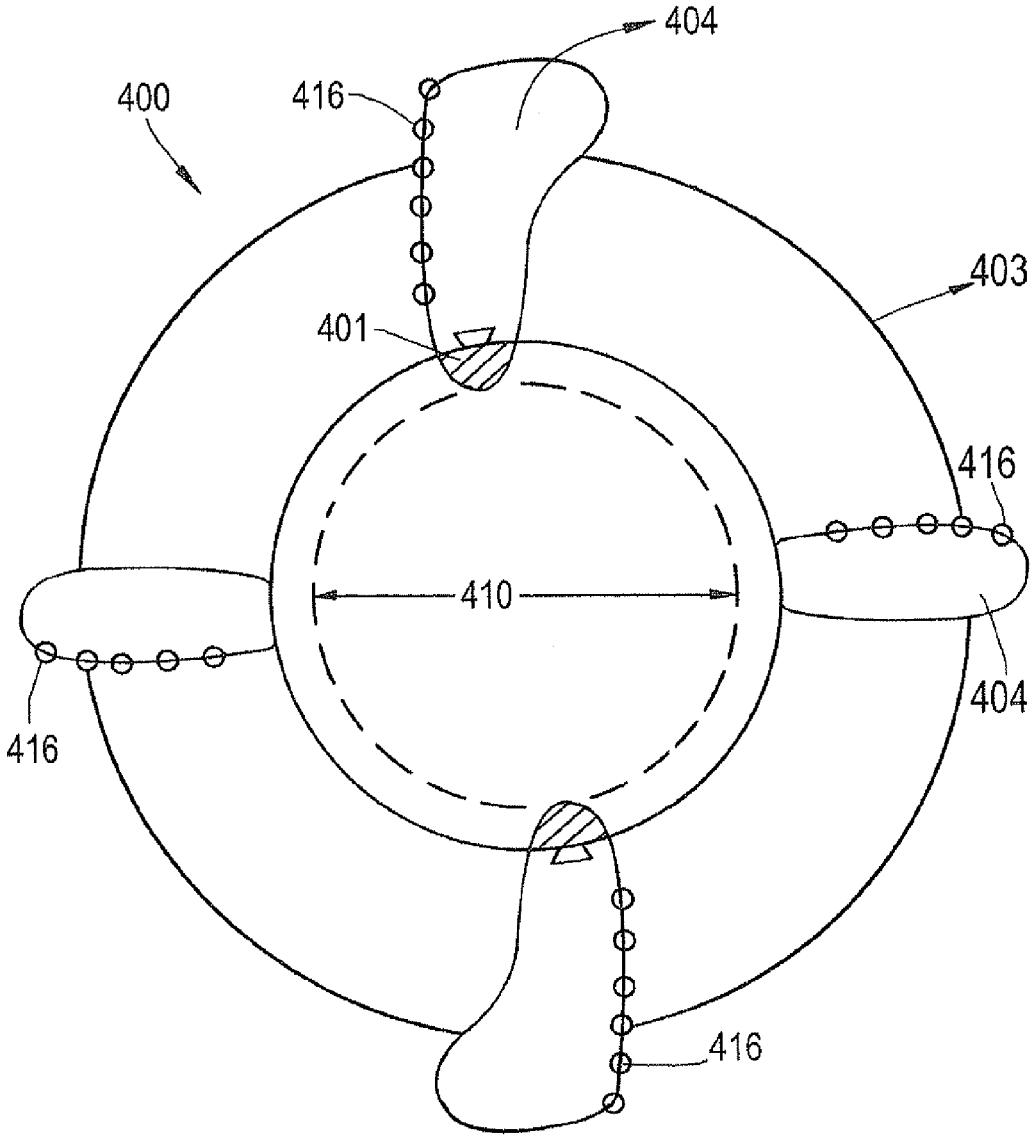
FIG. 10 shows an embodiment of the drill bit wherein the drill bit may be used as a coring bit.

In FIG. 10, a cross sectional view of coring bit 400 is shown. Blades 404 with coring cutters 401 are shown attached to crown 403. Additionally blades 404 are equipped with cutters 416. The coring cutters 401 are sized and positioned in order to trim the core to a size smaller than the passageway (indicated by line 410) and to allow the core to move upwards into the core barrel. Coring cutters 401 are removably arranged, i.e. so that they can be removed by shearing off or by passing a cutter removal tool (not shown) through the port.

Those of skill in the art will appreciate that many modifications and variations are possible in terms of the disclosed embodiments, configurations, materials, and methods without departing from their spirit and scope. Accordingly, the scope of the claims appended hereafter and their functional equivalents should not be limited by particular embodiments described and illustrated herein, as these are merely exemplary in nature and elements described separately may be optionally combined.

The invention claimed is:

1. A drill bit comprising:

a bit body connectable to a drill string at a first end, which bit body is provided with a longitudinal passageway extending from an opening at the first end to a port at a second end;

a closure element for closing the passageway, when the closure element is in a closing position, which closure element is removable, wherein the closure element comprises a first and a second member which are movable relative to each other between an expanded configuration and a collapsed configuration;

wherein, in the collapsed configuration, the closure element is retractable through the passageway to the first end and entirely into the bit body; and wherein, the closure element is extendable out past the port at the second end.

2. The drill bit according to claim 1, wherein the bit body, and the first and second members of the closure element are each provided with cutting elements.

3. The drill bit according to claim 1 further comprising:

a bit-connecting means for removably connecting the closure element to the bit body; and an extension/collapsing means for selectively bringing the first member and second member into the expanded or collapsed configuration.

4. The drill bit according to claim 3 wherein the bit-connecting means does not support a load whilst drilling.

5. The drill bit according to claim 3 further comprising an auxiliary tool for operating the bit-connecting means or the extension/collapsing means.

6. The drill bit according to claim 5 wherein the auxiliary tool comprises:

a tool-connecting means;

a release attachment; and a relatch attachment.

7. The drill bit according to claim 5 wherein the auxiliary tool is arranged to assume different configurations for different operating tasks selected from the group consisting of collapsing, disconnecting and retracting the closure element to surface and deploying, expanding and connecting the closure element from surface to the bit body.

8. The drill bit according to claim 3 wherein the bit-connecting means is a latch system comprising:

an outer sleeve;

an inner sleeve which slidably fits into the outer sleeve; and helical springs which push the inner sleeve away from the closure element.

9. The drill bit according to claim 3, wherein the expansion/collapsing means is a latch system comprising:

a lock cup;

a primary sleeve slidably inserted in the lock cup; and springs located within the lock cup.

10. The drill bit according to claim 1 wherein the first member and second member have the form of hingeable drill blades.

11. The drill bit according to claim 1 wherein the port at the second end of the bit body forms a central opening of the bit body, and wherein the surface of the central opening is provided with coring cutters.

12. The drill bit according to claim 11 wherein the coring cutters are removably arranged.

13. A method for performing wellbore operations with a drill bit comprising a bit body connectable to a drill string at a first end, which bit body is provided with a longitudinal passageway extending from an opening at the first end to a port at a second end comprising:

(a) providing a closure element for closing the passageway, wherein the closure element comprises a first and a second member which are movable relative to each other between an expanded configuration and a collapsed configuration such that the closure element is retractable through the passageway to the first end in the collapsed configuration and extendable out past the port at the second end;

(b) inserting the drill bit and closure element into a borehole with the first member and the second member in a collapsed configuration;

(c) expanding the first member and second member into the expanded configuration;

(d) performing a first wellbore operation;

(e) collapsing the first member and second member into the collapsed configuration;

(f) retrieving the closure element from the borehole;

(g) inserting a wellbore tool into the passageway and performing a second wellbore operation;

(h) removing the wellbore tool;

(i) reinserting the closure element into the drill string in a collapsed configuration; and (j) expanding the first member and the second member into the expanded configuration.

14. The method of claim 13 wherein the first wellbore operation is drilling.

15. The method of claim 13 wherein the second wellbore operation is logging, coring, installing, equipment, or other known wellbore operations.

* * * * *